United States Patent [19]

Sakai

[11] Patent Number: 4,533,272

[45] Date of Patent: Aug. 6, 1985

[54] WRITING INSTRUMENT WITH MOVABLE CLOSURE

[75] Inventor: Kenji Sakai, Aichi, Japan

[73] Assignee: Pilot Ink Company, Japan

[21] Appl. No.: 554,409

[22] Filed: Nov. 22, 1983

[30] Foreign Application Priority Data

Nov. 26, 1982 [JP] Japan ..... 57-179259[U]

[51] Int. Cl.[3] ..... B43K 9/00; B43K 7/12

[52] U.S. Cl. ..... 401/107; 401/108; 401/116

[58] Field of Search ..... 401/107, 108, 116

[56] References Cited

U.S. PATENT DOCUMENTS

| | | | |
|---|---|---|---|
| 1,063,134 | 5/1913 | Norris | 401/107 X |
| 1,580,987 | 4/1926 | Alford | 401/108 |
| 4,218,154 | 8/1980 | Erfer | 401/107 |

FOREIGN PATENT DOCUMENTS

| | | | |
|---|---|---|---|
| 1561814 | 4/1970 | Fed. Rep. of Germany | 401/107 |
| 506654 | 12/1954 | Italy | 401/108 |
| 257750 | 10/1948 | Switzerland | 401/108 |
| 1400781 | 7/1975 | United Kingdom | 401/108 |

*Primary Examiner*—Steven A. Bratlie

*Attorney, Agent, or Firm*—Sughrue, Mion, Zinn, Macpeak, and Seas

[57] ABSTRACT

A writing instrument with a movable closure, having a snap member for automatically closing the opening at the forward portion of the tapered front end of the writing instrument as the writing unit, within the writing instrument, is retracted. The snap member includes a cylindrical end and a plurality of resilient support segments extending from said cylindrical end and terminating in covers attached to or integrally formed on the ends of the support segments opposite the cylindrical end. These covers provide an airtight seal at the open front end of the writing instrument as they close upon each other in response to the forward movement of the snap member, when the writing instrument is placed in its projected, writing position, the snap member is moved rearwardly, out of the open front end of the writing instrument toward the larger diameter section of the tapered front end. Since the resilient support segments are no longer constricted within the narrow diameter front end opening, they expand radially, opening the covers to provide a passage through which the writing unit can pass.

3 Claims, 12 Drawing Figures

WRITING INSTRUMENT WITH MOVABLE CLOSURE

BACKGROUND OF THE INVENTION

This invention relates to a writing instrument with a movable closure and, more particularly, to a writing instrument with a movable closure which is fabricated to repeat the operations of projecting a writing nib of a writing unit from an opening in a barrel to a writing position, and retracting and storing the writing unit in an airtight environment within the barrel in a closed or non-writing position.

Various proposals have been made to provide snap means such as a closure, for the writing instrument nib of the aforementioned type of writing instrument. Structures have been suggested, by way of example, which are adapted to project the writing nib into the writing position by using an actuating member which is caused to press down on an elastic rubber cover or the like with a cut or slit or to press on and thereby open a snap cover mounted on the barrel end. The first mentioned structure offers the advantage of simple construction. Notwithstanding, the pen element directly rubs the elastic rubber cover to occasionally imperil a snap function if it is frequently, repeatedly operated. Direct adhesion of ink to the pen element over long use deteriorates the rubber to impede the sealing effect. Also, the pen point is subjected to damage due to the repeated use thereof.

On the other hand, the second pressure mechanism with the actuating member, undoubtedly overcomes defects inherent in the prior art. However, the construction in which the snap cover is exposed to a holder end, is deficient in that damage to the exposed portion may result. Further, this construction fails to exhibit satisfactory performance as to durability, and airtightness after many repeated operations. This limits the design of the writing instrument nib. Therefore, the known structure which incorporates the snap cover in the holder end is lacking in reliability, durability, and airtightness.

SUMMARY OF THE INVENTION

According to the teachings of the invention, there is provided a writing instrument with a movable closure, having a snap member with a cylindrical end and a plurality of elastic support segments extending from said cylindrical end and terminating in covers attached to or integrally formed on the ends of the support segments opposite the cylindrical end. The snap member is slidably inserted into the front portion of the writing instrument's holder barrel, this front portion having a tapered, reduced front end opening from which a writing unit projects when the writing instrument is in its projected, writing position. A slider member and cam sleeve operatively connected to the writing instrument's projecting and retracting mechanism, are connected to the snap member to cause the snap member, and particularly the support segments thereof to slide in a forward direction toward the front end opening of the holder barrel thereof, thereby forcing the snap member covers into their closed position in the front end opening of the holder barrel, against the outwardly directed radial forces produced by the elastic support segments when the writing instrument is moved to its retracted, non-writing position. In their closed position, the snap member covers provide an airtight seal at the front end of the holder barrel. When the writing instrument is moved to its projected position, the slider member moves the snap member rearwardly. As this occurs, the support segments of the snap member travel along the inner surface of the tapered front end of the holder barrel in the direction of increasing diameter. This releases the radial pressure exerted on the elastic support segments by the holder barrel, and causes the covers to open under the influence of the outwardly directed radial forces produced by the resilient support segments. With the covers opened, the writing unit can extend through the front end opening of the holder barrel.

An embodiment of the invention will become apparent with reference to the following description and the accompanying drawings.

DESCRIPTION OF THE PREFERRED EMBODIMENT

Referring to the accompanying drawings and particularly, FIGS.1–7, a nib of a writing instrument will be explained.

Figure 1:
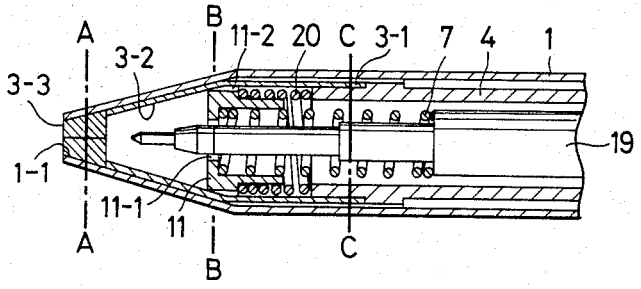
FIG. 1 is a longitudinal section of a writing instrument according to the invention, showing the main part of the writing instrument nib in a retracted or non-writing position.
Figure 2:
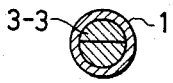
FIGS. 2, 3, and 4 are longitudinal sections taken along lines A—A, B—B, and C—C, respectively, in FIG. 1.
Figure 3:
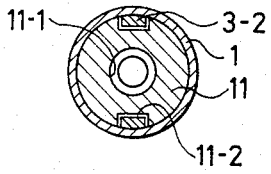
Figure 4:
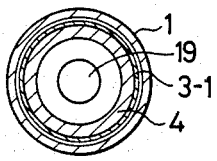
Figure 5:
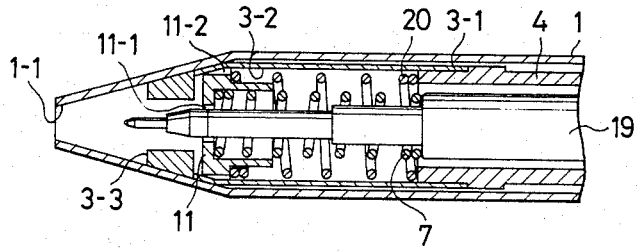
FIG. 5 is a longitudinal section of the main part of the writing instrument showing the nib in a neutral or intermediate position which occurs when the instrument is operated.
Figure 6:
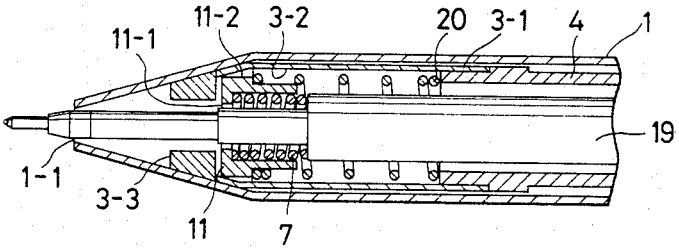
FIG. 6 is a longitudinal section of the main part of the writing instrument nib when it is in its projected or writing position.
Figure 7:
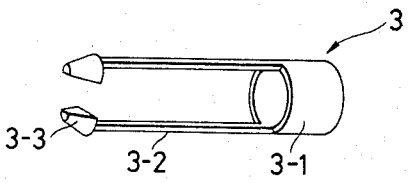
FIG. 7 is a perspective view of the snap member.

A holder barrel 1 is tapered to a reduced diameter at an open-ended portion 1-1. An elastic snap member 3 includes a cylinder 3-1 and two support segments 3-2 of sheet metal which extend from the cylinder and which are provided at the ends thereof with inward covers 3-3. The snap member 3 elastically abuts against the interior of the holder barrel. The snap member 3 is axially, slidably adjusted by movement of a tubular slider 4 connected to the cylinder 3-1. An annular support 11 which includes recesses 11-2 on its surface and a center hole 11-1 is located interior of the snap member 3 and is also fixedly disposed in the interior of the holder barrel. The annular support 11 passes through the support segments 3-2 to allow a nib of a writing unit 19 to be loosely inserted in the center hole. In the retracted or non-writing position, the covers 3-3 of the snap member 3 disposed on the inner periphery of the barrel end abut against one another (FIG. 2). This maintains the incorporated writing unit 19 in an airtight condition. The writing unit is operated to withdraw the snap member 3 as shown in FIG. 5. By releasing pressure radially, the writing unit 19 is operatively advanced through an intermediate position where the covers 3-3 are open but the nib is retracted to a projected or writing position (FIG. 6) where the nib extends beyond open-ended portion 1-1 while the covers 3-3 remain open.

With such a construction, when the writing unit is in the retracted, non-writing position, the snap member 3 is slid into contact with the inner surface of the tapered reduced portion 1-1 to close the covers 3-3 at the end of the barrel to thereby maintain an airtight seal. On the other hand, radial release of pressure toward an enlarged portion of the holder barrel 1 gradually opens the covers. This radial pressure release occurs when the snap member 3 is allowed to move rearwardly in the barrel 1. In order to effectively produce this reciprocating motion, the support segments 3-2 should be elastic. For this reason, rigid, elastic blanks such as sheet metal, plastic or the like may be preferable. The inward directed covers 3-3 are normally separated from the support segments 3-2, made of rubber-like elastic material or any other sealing material, and mounted on the ends of the support segments. The inward covers may also be integrally formed on the ends of the support segments. The support segments 3-2 and the covers 3-3 are not limited in number to two, as shown, but may be three to eight in number if necessary. The annular support 11 functions not only as a spring seat for elastically supporting the writing unit 19 by a spring member 7 and/or another spring seat for the slider 4, but also as a guide for the writing unit end. The slider 4 is loosely inserted in the holder barrel 1 with a spring member 20 being placed between the slider 4 and the support 11. The slider 4 is coupled to a cam mechanism 8 which when operated causes the slider 4 to either advance or retract. When in its advanced position, spring member 20 is cam pressed and snap member 3 is maintained in its advanced or closed position in the forward end of barrel 1.

In the disclosed embodiment, the cylinder 3-1 of the snap member 3 is shown as directly connected to the slider. However, it may be designed so that its stress on the snap member 3 is converted to an elastic force by interposing a spring member, whereby stress on the support segments 3-2 is relieved to prevent the support segments from bending and breaking due to excessive pressure. This allows the covers 3-3 reliably to open and close many, many times. The cylinder 3-1 may be provided with slits and the like for facilitating its attachment to the slider.

The writing instrument nib or point according to the invention is fabricated as aforementioned to remedy shortcomings of the conventional opening and closing structure, thereby providing positive and stable opening and closing operations of the covers 3-3. Various writing units may be incorporated into the structure described herein.

Referring to FIGS. 8–12, the writing instrument as a whole, according to the invention, will be further explained.

Figure 8:
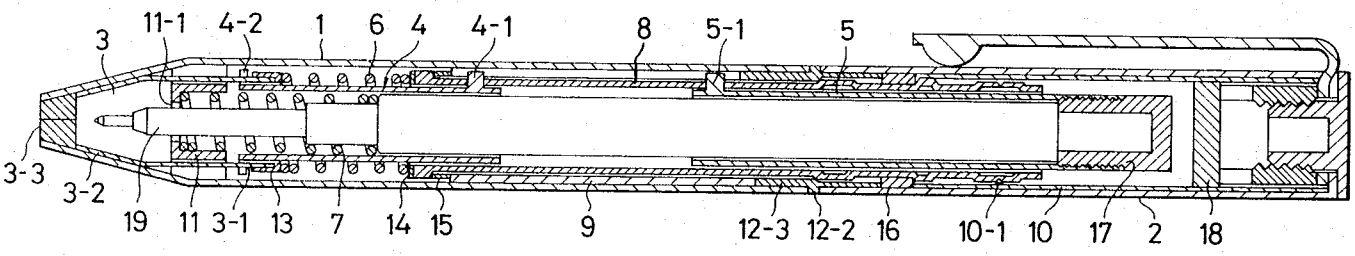
FIG. 8 is a longitudinal section of the writing instrument according to the invention.
Figure 10:
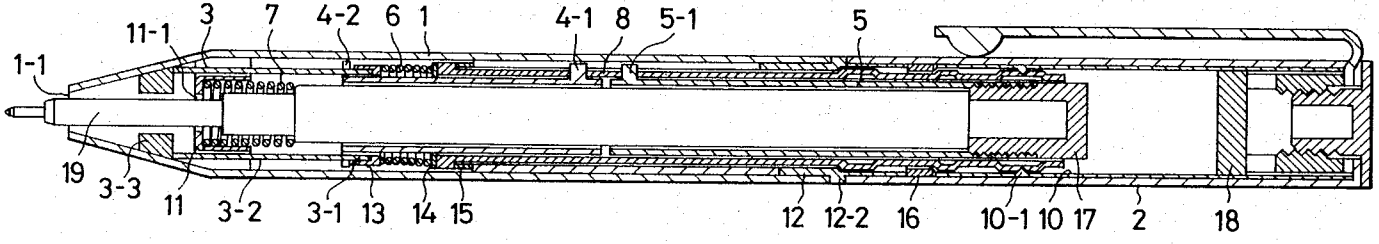
FIG. 10 is a longitudinal section of the writing instrument in its projected position.

The holder barrel 1 is tapered to a reduced diameter at its forward open-ended position 1-1 to provide a reduced portion. The elastic snap member 3 includes the cylinder 3-1 and two support segments 3-2 of sheet metal which extend from the cylinder and which are provided at one of their ends with inward covers 3-3. The snap member 3 elastically abuts against the interior of the holder barrel 1. The snap member 3 is adapted to have its cylinder 3-1 loosely mounted over the first slider 4 so as to be able to rearwardly pass over a flange 4-2 thereof. The cylinder 3-1 and a rearwardly disposed cam sleeve 8 are connected by a spring member 6 between the rear end of the former and the front end of the latter (a washer 14 may be disposed on the front end of the cam sleeve, if desired). A pin 5-1 of a slider 5 is inserted in a rear cam groove 8-2 formed in the cam sleeve 8 which is axially slidably adjusted in association with the operation of the slider. The annular support 11 is positioned interior of the snap member 3 and includes the recesses 11-2 on its surface and the center hole 11-1. It is fixedly disposed in the interior of the holder barrel. The annular support 11 passes through the support segments 3-2 to have the tip end of the writing unit 19 loosely inserted in the center hole whereas the spring member 7 is retained between the support 11 and the front of the writing unit. The rear of the writing unit 19 is adapted to engage with a second, tubular slider 5 which includes the pin 5-1, which fits in the rear cam groove 8-2 of the cam sleeve 8. The pins 4-1 and 5-1 are arranged so that they are suitably spaced away from one another in a slit 9-1 of a guide tube 9 fixed to the holder barrel 1 to thus permit their operation. When the pen is in its non-writing position as shown in FIG. 8, the covers 3-3 of the snap member are positioned on the inner periphery of the forward end of the holder barrel 1 against one another and are closed to prevent the writing nib from drying out. The snap member 3 is withdrawn by operating the writing nib. The writing unit is in turn advanced and operated through an intermediate position where the covers 3-3 are open by radially releasing pressure, to a writing condition (FIG. 10).

Thus, the snap member 3 is slid into contact with the inner surface of the tapered, reduced portion to close the covers 3-3 at the end of the barrel to maintain an airtight condition. On the other hand, the radial release of pressure as the snap member 3 moves rearwardly gradually opens the covers 3-3. In order to effectively produce this reciprocating motion, the support segments 3-2 should be elastic. For this reason, elastic blanks such as sheet metal, plastic and the like are preferable. The inward covers 3-3 are normally made of rubber-like elastic material or any other sealing material, separately of the support segments and one mounted on the ends of the support segments. The inward covers may also be formed integrally with the ends of the support segments. The support segments 3-2 and the covers 3-3 are not limited to two in number as shown, but may be three to eight in number, if necessary. The cylinder 3-1 may be provided with an axial slit for facilitating its attachment to the slider.

The covers 3-3 are advanced and closed (FIG. 8) by the elastic force of the spring member 6 adapted to connect the cylinder 3-1 of snap member 3 to the flange 4-2 of first slider 4 so as to moderate and modify the stress on the support segments 3-2. This protects the latter against the bending and breaking which might result if the snap member was directly depressed with excessive loading.

When the covers are to be opened, the slider 4 is operated and as the slider is operated, the cylinder 3-1 of the snap member is engaged by the flange 4-2, which has been displaced to a writing position. At this moment, the spring member 6 is axially compressed as shown in FIG. 10.

Figure 9:
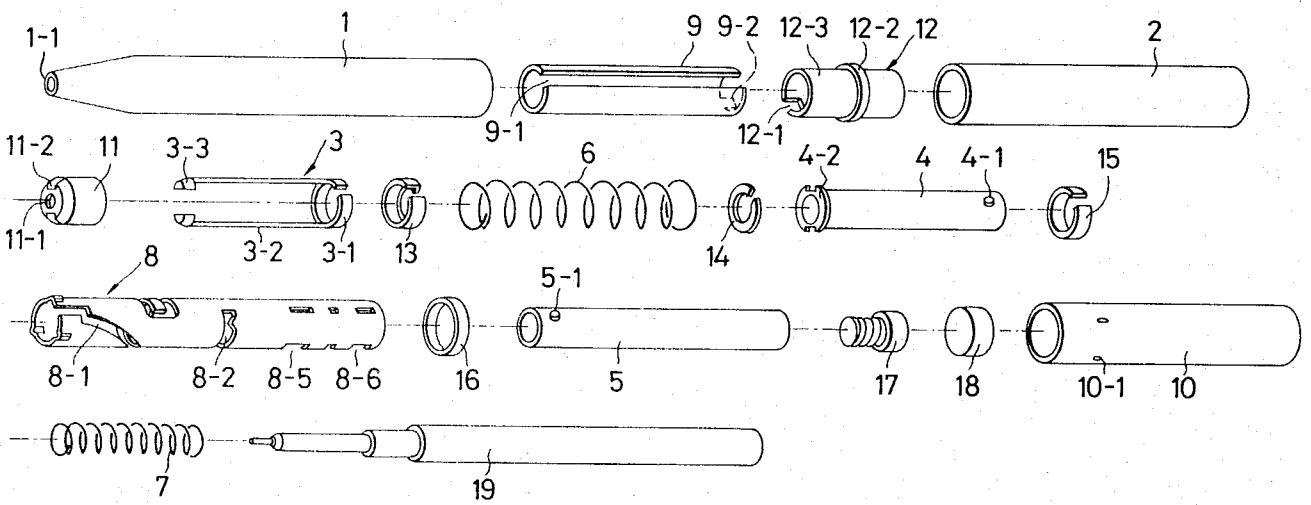
FIG. 9 is an exploded perspective view of the components which constitute the writing instrument.
Figure 11:
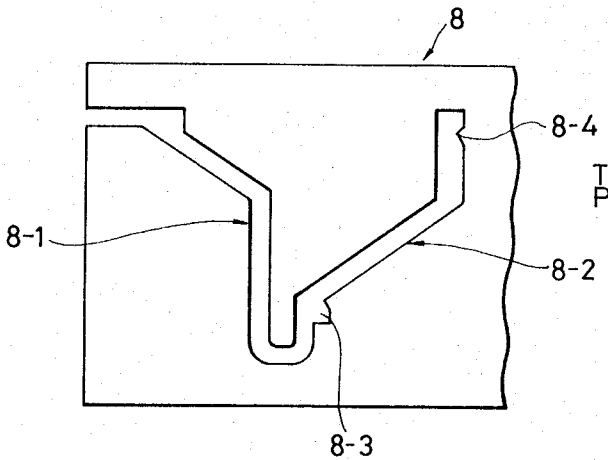
FIG. 11 is a development view of the cam sleeve.

The cam sleeve 8 includes first and rear cam grooves 8-1 and 8-2 which are continuously and successively formed as shown in FIGS. 9 and 11. The pin 4-1 of the first slider 4 and the pin 5-1 of the second slider 5 fit in the front and rear cam grooves 8-1 and 8-2, respectively, and are engaged in the slit 9-1 in the guide tube 9 secured to the holder barrel. These sliders are adapted to allow the advance and retraction thereof by rotation of the cam sleeve 9. More specifically, the guide sleeve 9 is firmly held in position against the holder barrel by having a rear lug 9-2 of the guide sleeve 9 fitted in a recess 12-1 of a stationary member 12. Projections 8-5 and 8-6 formed rearwardly of the outer periphery of the cam sleeve 8 are engaged by inward projections 10-1 of a cylindrical casing 10 located on the interior of the rear holder barrel 2 so that the cam sleeve 8 is rotated in association with the rotational operation of the rear holder barrel to thus advance and retract the snap member 3 and the writing unit 19. In this connection, it is noted that the rear holder barrel 2 and the cam sleeve 8 may be bodily rotated and operated whereas the rear holder barrel 2 and the cylindrical casing 10 may be readily taken out from the cam sleeve 8.

A tail plug 17 is removably mounted on the second slider 5 at the rear end thereof and an O-ring 16 is positioned between the projections 8-5 and 8-6 and received in the interior of the holder barrel and pressed between the front end of the cylindrical casing 10 and the rear end of the stationary member 12 to provide an airtight seal between the holder barrel and the stationary member 12. The cap 18 is forced into the interior of the cylindrical casing 10 at the rear end thereof to thus maintain an airtight seal against a clip mounting portion of the rear holder barrel 2.

The mechanism by which the cam sleeve 8 is actuated will now be explained.

Figure 12:
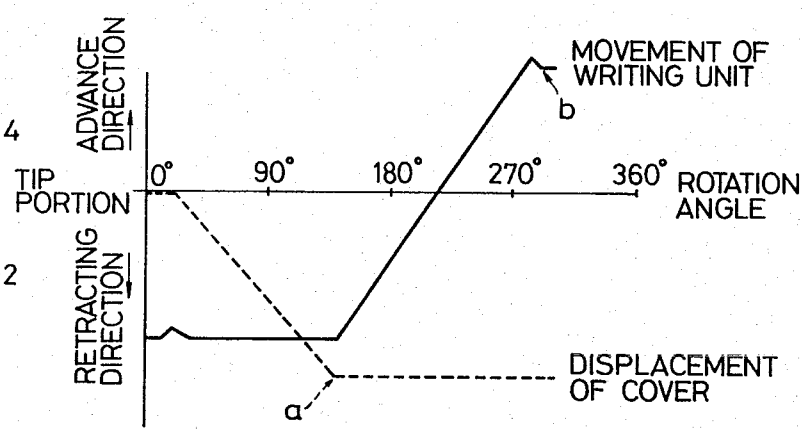
FIG. 12 is a graph defining the operation of the cam section.

FIG. 11 is a developed view showing the major part of the cam sleeve and FIG. 12 is a plot of nib position versus the angle of rotation of cam sleeve 8, useful in explaining the operation of the cam sleeve 8.

As shown in FIG. 11, the cam sleeve 8 is provided with front and rear cam grooves 8-1 and 8-2 integrally and successively formed therein. The cam grooves 8-1 and 8-2 receive the pins 4-1 and 5-1 of the sliders to allow the rear holder barrel 2 to rotate the sliders, thereby advancing and retracting the sliders. More specifically, clockwise rotation of the rear holder barrel retracts, according to its rotational angle, the snap member 3 disposed in its closed position in the inner periphery of the barrel end 1. The covers 3-3 are opened when they reach a point (a) (where the groove 8-1 is obliquely run). Next, the covers 3-3 are held in a stand-by position (where they are not moved in an axial direction). On the other hand, the writing unit goes through the stand-by position and is advanced to point b as the pin 5-1 moves through the oblique portion of cam groove 8-2 as shown in FIG. 12. The writing unit may be moved backwardly by reversing the just described operation. The snap member then moves to its closed position when the covers 3-3 close to provide an airtight seal. The cam sleeve 8 includes abutments 8-3 and 8-4 in the groove to provide stroke for the snap member and the writing unit to see where they are moved. The cam groove 8-1, 8-2 is not limited to the continuous configuration but may be formed in a discontinuous configuration.

The writing instrument with the movable closure according to the invention is fabricated as aforementioned to remedy the shortcomings of the prior art referred to previously herein, thereby maintaining a positive and stable opening and closing operation of the covers.

The invention may be applicable to various types of writing instruments in such a manner that an applicator or marker having a solvent and toiletries such as an eyebrow pencil, lipstick and the like, are projectably and retractably provided.

I claim:

1. In a writing instrument with a movable closure fabricated to repeat the operation of operatively rotating a rear holder barrel (2) to actuate a cam sleeve (8) so that a writing section (19) of a writing unit is projected from an opening (1-1) in the holder barrel (1) into a writing operation and retracted and stored in an airtight condition within the barrel in a non-writing operation, said writing instrument with the movable closure including: a front holder barrel (1) with a tapered reduced diameter at its forward open-ended portion (1-1), an elastic snap member (3) including a cylinder (3-1) and a plurality of support segments (3-2) which extend from the cylinder and which are provided at one end thereof with inward covers (3-3), the snap member (3) being disposed on the inner surface of the front holder barrel (1) and being adapted to have its cylinder (3-1) loosely mounted over a first slider (4) having a forward positioned flange (4-2) for connection with the cylinder (3-1) and a rearwardly located pin (4-1), a cam sleeve (8) having cam grooves (8-1, 8-2), the cylinder (3-1) and the cam sleeve (8) being connected by a spring member (6) between the rear end of the former and the front end of the latter, the cam sleeve (8) having the front cam groove (8-1) for receiving the pin (4-1) of the slider (4), the writing unit (19) being disposed along the center axis of the holder barrel (1,2), its front end engaging a spring member (7), its rear end engaging a second slider (5), having a pin (5-1), the pin (5-1) being inserted in the cam groove (8-2), positioned at the rear of the cam sleeve, the pins (4-1) and (5-1) being arranged so that they are located in a slit (9-1) of a guide tube (9) fixed to the front holder barrel (1), whereby rotational operation of the rear holder barrel (2) in one direction causes the covers (3-3) to move into a closed position while rotation of the rear holder barrel in the opposite direction causes the covers (3-3) to be retracted causing a radial release of pressure on the support segments (3-2) causing the covers (3-3) to open simultaneously with the advance of the writing unit 19 to its projected position.

2. In the writing instrument as claimed in claim 1, further including, an annular support (11) including recess (11-2) on its outer surface and having a center hole (11-1), said annular support being fixedly disposed in the interior of said snap member (3) such that it passes through the support segments (3-2) to allow the nib of a writing unit to be loosely inserted in its center hole (11-1).

3. The writing instrument of claim 1, further including means coupled to the rear portion of the writing unit for causing said cam sleeve to selectively rotate in either the clockwise or counterclockwise direction.

* * * * *